United States Patent [19]

Haggarty

[11] 4,204,677

[45] May 27, 1980

[54] BASEBALL THROWING PRACTICE TARGET

[76] Inventor: Michael J. Haggarty, 8453 Carter, Overland Park, Kans. 66212

[21] Appl. No.: 869,017

[22] Filed: Jan. 12, 1978

[51] Int. Cl.[2] ..... A63B 69/40

[52] U.S. Cl. ..... 273/26 A; 273/409

[58] Field of Search ..... 273/26 A, 127 R, 127 C, 273/102 R, 102 PM, 102 S, 102.1 CM, 55 R, 55 A, 157 R, 51, 157; 46/25, 26, 24, 16, 17, 19; 272/76, 77, 78

[56] References Cited

U.S. PATENT DOCUMENTS

| | | | |
|---|---|---|---|
| 720,615 | 6/1902 | Barden | 273/157 R |
| 1,207,504 | 12/1916 | Converse | 46/25 |
| 1,652,062 | 12/1927 | Stauffer | 273/26 A |
| 1,719,239 | 7/1929 | Scanlon | 273/102 R |
| 2,162,438 | 6/1939 | Setaret | 273/26 A |
| 2,873,969 | 2/1959 | Ziel | 273/26 A |
| 2,986,398 | 5/1961 | Oliver | 273/26 A |
| 3,312,467 | 4/1967 | Dawson | 273/26 A |
| 3,341,197 | 9/1967 | Bottorff | 273/51 |
| 3,583,703 | 6/1971 | Brown | 273/26 A |
| 3,810,616 | 5/1974 | Murphy | 273/26 A |

FOREIGN PATENT DOCUMENTS

| | | | |
|---|---|---|---|
| 652969 | 5/1951 | United Kingdom | 273/157 R |

*Primary Examiner*—Richard C. Pinkham
*Assistant Examiner*—T. Brown
*Attorney, Agent, or Firm*—Fishburn, Gold & Litman

[57] ABSTRACT

A baseball throwing practice target device is comprised of a series of selectively rotated and stacked block members which are removably engaged upon a generally vertically extending upright structure secured to a weighted base plate. The block members have various target design patterns applied to the faces thereof, thereby providing a versatile arrangement in which the target height, area and specific location can be selected as desired for differently sized and skilled players.

4 Claims, 5 Drawing Figures

BASEBALL THROWING PRACTICE TARGET

This invention relates to a throwing target for improving the proficiency of a baseball pitcher or other players, and in particular, to a target device which is easily adjustable in target height, area and specific relative location.

Practice targets for baseball and other throwing sports are useful to develop and maintain proficiency, regardless of the age or experience of the hurler. Pitching targets heretofore available usually consisted of appropriately configured panels or sheets secured to a backstop or net assembly. These were difficult to adjust commensurately with the size of the intended batter or with a desired target area or location. Thus, for example, it was not convenient to present the pitcher with the "inside lower corner" in the strike zone of a batter who is five feet in height.

The principle objects of the present invention are: to provide a baseball throwing practice target device which is easily adjustable in target height, area and relative location; to provide such a device which is readily moveable; to provide such a device which is easily disassembled for storage; to provide such a device which is sturdy and able to withstand repeated blows by thrown objects; and to provide such a device which is highly reliable and durable in use and well adapted for its intended purpose.

Other objects and advantages of this invention will become apparent from the following description taken in connection with the accompanying drawings wherein are set forth by way of illustration and example, certain embodiments of this invention.

FIG. 4 is an exploded, partially fragmentary, perspective view of the device including a deflector member for optional use therewith.

Figure 1:
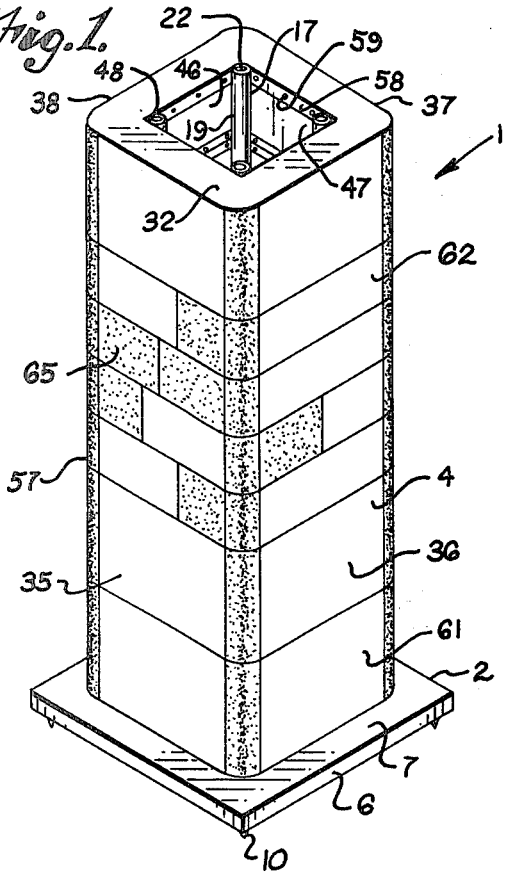
FIG. 1 is a perspective view of a baseball throwing practice target device embodying this invention and showing various target patterns on portions thereof.
Figure 2:
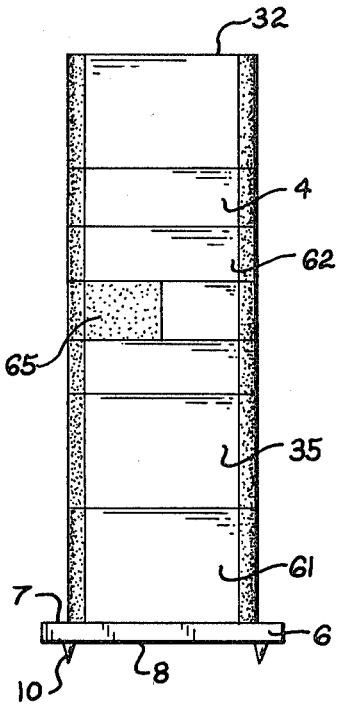
FIG. 2 is a frontal elevational view of the device showing one target pattern arrangement which may be formed thereon.
Figure 3:
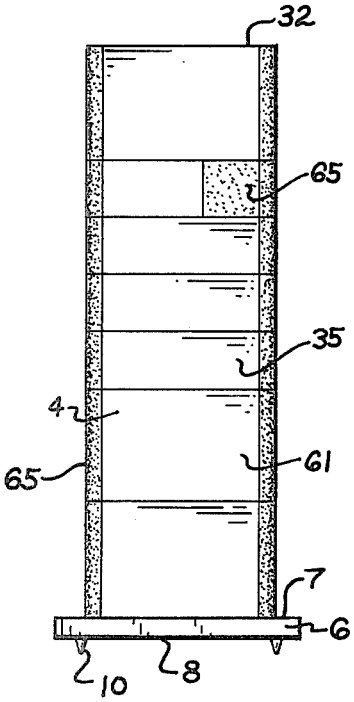
FIG. 3 is a frontal elevational view of the device showing another target pattern arrangement which may be formed thereon.

Referring to the drawings in more detail:

The reference numeral 1, FIG. 1, generally indicates a baseball throwing practice target device embodying this invention. The target device 1 is comprised of a rectangular frame structure 2 receiving a plurality of block members 4 which are selectively stackable in a column and relatively rotatably variable in orientation.

In the illustrated example, the frame structure 2 includes a weighted base member 6 which is characterized by opposed, flat, rectangular upper and lower surfaces 7 and 8, thereby forming a planar body comprised of relatively heavy material such as iron, steel, or the like. The base member 6 is adapted to be positioned on the ground and has a plurality of earth-engaging members, such as spikes 10, extended from the lower surface 8, which dig into the soil and inhibit horizontal sliding movement. The upper surface 7 has a plurality of apertures 13 extended vertically thereinto, FIG. 4, and engagement means 14, such as threads are formed therein for receiving the ends of a plurality of generally vertically extending, spaced apart, parallel upright members 17.

Referring to FIG. 4, the upright members 17 are comprised of a plurality of separate segments 19 of elongated tubular shape and formed of sturdy and deformation resistant material, such as steel or the like. Each segment 19 includes an internally threaded female upper end 22 and a downwardly directed mating male threaded end 24 sized for end-to-end engagement with the next succeeding segment 19. Accordingly, the segments 19 may be selectively assembled in a line to form an upright member 17 and selectively disassembled to shorten the height or for disassembly and storage of the entire target device. Preferably, the segments 19 are of a length generally commensurate with the height of the block members 4 so that the height of the frame structure 2 conforms to the number of block members 4 stacked thereon.

In the illustrated embodiment, four upright members 17 are rectangularly positioned and engaged with the receiving apertures 13 so that each member 17 forms a corner of the frame structure 2.

A plurality of the block members 4, are stacked vertically in a column upon the base member 6 and slideably engaged with the upright members 17. Each block member 4 may be of different shape but in the illustrated example is rectangularly formed, having flattened top and bottom surfaces 32 and 33 with sides or surfaces 35, 36, 37 and 38 in surrounding relation. Each block member 4 has an internal aperture 44 extended therethrough which is of a rectangular shape and size commensurate with the positioned upright members 17. The aperture 44 has opposite internal sides or surfaces 46 and 47, forming right angled corners 48 and sized to be sleeved over the frame structure 2 with each upright member 17 engaging a respective corner 48. So constructed, the block members 4 are not rotatable when positioned on the frame structure 2, but must be lifted, disengaged from the members 17 and rotated in order to present a different target pattern, as described in detail below.

Each side 35–38 of a block member 4 is comprised in cross-section, FIG. 4, of a sturdy, relatively heavy backing plate 51 of wood or the like similar durable material. A thick layer of resilient padding 53 such as synthetic foam or fiber is positioned outwardly of the plate 51 to absorb the force of balls thrown thereagainst. Protecting the padding 53 is a durable cover 55 of leather or the like wear and tear-resistant material designed to withstand repeated blows and scuffs. The cover 55 embraces the sides 35–38, extends over the top and bottom surfaces 32 and 33, and forms rounded corners 57. To secure the cover 55 to the plate 51, strip portions 58 of the cover 55 are extended over the top and bottom margins of the plate 51 and in the illustrated example, are secured thereto by fasteners 59, such as nails, screws, or the like.

The block members 4 are preferably of various vertical height dimensions for flexibility of arrangement. For example, a block 61 is substantially greater in height than a block 62. Further, selected block members 4 have a target design or pattern 65 applied thereto, comprising various sides stripes, bars, left or right colored panels and the like. Moreover, it is desired that each side 35–38 have a different pattern applied thereon than the other side, thereby permitting flexibility in use.

Together, the selectively removable and stackable block members 4 with various designs 65 permit great versatility in target arrangements. For example, when used for "Little League" activities, one of the taller blocks 61 can be removed to create a shorter target device 1 with a strike zone commensurately positioned for younger players. Or, the block members 4 can be selectively rotated, repositioned, or even flipped over, presenting different designs 65 simulating particular areas in strike zones for left or right-handed batters. Also, designs 65 on several block members 4 can be associated or grouped together to form a relatively large target area for neophyte pitchers, which can be made progressively smaller as throwing skill, and therefore accuracy, increases.

Not only is the target device 1 useful for pitchers, but it is useful by other players equally as well, i.e., basemen and catchers can use the device for targets relating to their positions and the target design 65 can be altered accordingly.

Figure 5:
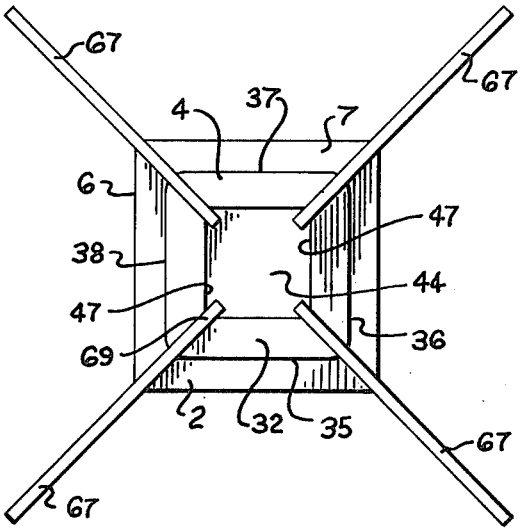
FIG. 5 is a top plan view of the target device having a plurality of deflector members connected thereto.
Figure 1:
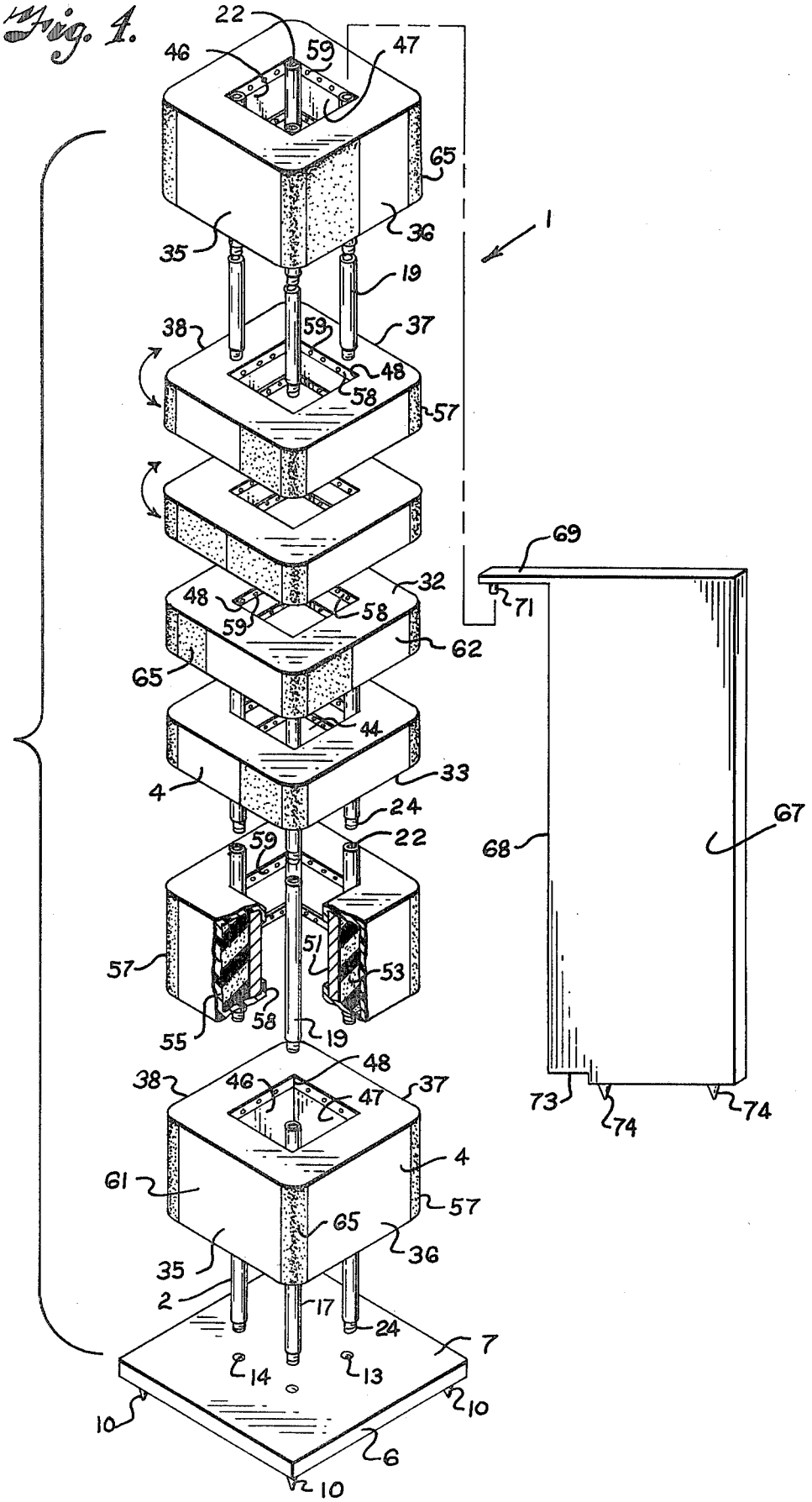

As illustrated in FIGS. 4 and 5, wings or deflectors 67 may be provided which are removably attached to the frame structure 2 to deflect and catch balls which would otherwise miss the target device 1. The deflectors 67 are comprised of vertically elongated, generally rectangular, planar members having a block-engaging side portion 68. An upper arm member 69 projects from the deflector 67 and has a downwardly extending shaft or protuberance 71 thereon which is sized for insertion into the open end 22 of the top segment 19. A bottom end 73 of the deflector 67 has a recessed or indented portion 73 to mate with the base member 6 and includes earth-engaging members such as spikes 74 to secure the deflector 67 against sideward movement. The deflectors 67 may be positioned every ninety degrees around the frame member 2 so that the side portions 68 abut the corners 57, thereby better adapting the target device 1 for simultaneous use by several pitchers throwing from different positions. Thus, the target device 1 may be particularly useful to provide a target for several pitchers to warm-up and prepare for a game.

It is to be understood that while certain forms of this invention have been illustrated and described, it is not to be limited thereto except insofar as such limitations are included in the following claims.

What is claimed and desired to secure by Letters Patent is:

1. A practice target device for baseball and like activities, comprising:

(a) a frame structure including a base member and a generally vertically extending upright support member having its lower end connected to said base member;

(b) said upright member comprising a plurality of upright elements arranged in a rectangular pattern, each of said upright elements comprising a corner of said rectangular pattern; and (c) a plurality of block members having generally flattened top and bottom surface and outer sides, said sides having various target design patterns applied thereon;

(d) each said block member having an aperture extended therethrough from said top to bottom surfaces and sized to receive said upright member, said block members being selectively rotatable in a horizontal plane and selectively positioned in stacked engagement with said upright member extended through said apertures whereby various target design patterns appear on said target device in desired placement.

2. The practice target device as set forth in claim 1 wherein:

(a) said block member apertures are rectangularly shaped and sized to receive said rectangular pattern of upright members, each of said upright members being engaged with said block member in a corner formed in said aperture.

3. A practice target device for baseball and like activities comprising:

(a) a plurality of interchangeable and rotatable blocks forming an upright stack;

(b) said blocks respectively having at least two exposed faces adapted to withstand blows thereagainst and aligned with exposed faces of adjacent blocks;

(c) support means engaged with said blocks and retaining the integrity of said stack under the force of blows struck against said exposed faces; and (d) wing members attached to said stack and extending angularly outward thereof and extending upwardly beside said stack substantially the height of said stack for deflecting missiles striking said wing members toward said blocks.

4. The target device set forth in claim 3 wherein:

(a) said wing members include arms attached thereto and connected to said stack and rigidly positioning said wing members at an angle to said blocks.

* * * * *